United States Patent [19]

Pelin

[11] 4,283,907

[45] Aug. 18, 1981

[54] DOUBLE TWIST SPINDLE INCLUDING A DRIVE WITHOUT CONTACT BETWEEN ITS PLATE AND ITS STABILIZER

[75] Inventor: Marcel Pelin, La Mulatiere, France

[73] Assignee: Verdol S.A., Caluire, France

[21] Appl. No.: 113,872

[22] Filed: Jan. 21, 1980

[30] Foreign Application Priority Data

Jan. 26, 1979 [FR] France ..... 79 02587

[51] Int. Cl.[3] ..... D01H 7/86

[52] U.S. Cl. ..... 57/58.76; 57/58.72

[58] Field of Search ..... 57/58.49, 58.72–58.81

[56] References Cited

U.S. PATENT DOCUMENTS

| | | | |
|---|---|---|---|
| 2,524,217 | 10/1950 | Ancet | 57/58.72 |
| 2,534,496 | 12/1950 | Agresti | 57/58.76 X |
| 2,541,541 | 2/1951 | Pellat-Finet et al. | 57/58.72 |
| 4,137,702 | 2/1979 | Monville et al. | 57/58.74 |
| 4,167,094 | 9/1979 | Verdollin | 57/58.72 |

FOREIGN PATENT DOCUMENTS 2358483 2/1978 France .

*Primary Examiner*—John Petrakes

*Attorney, Agent, or Firm*—Dowell & Dowell

[57] ABSTRACT

In a double-twist spindle comprising a shaft with a transversely elongated plate the ends of which support a rotatable annular disk, the bobbin-carrier rotatably supported by the shaft being maintained against rotation therewith by a hollow stabilizer which surrounds the shaft and which is itself rotatably mounted about an axis inclined with respect to the axis of the shaft, the first end of the stabilizer being mounted in the bobbin-carrier and the second end of the stabilizer being supported in a ring fixed to the frame and disposed on the other side of the elongated plate with respect to the bobbin-carrier, the said stabilizer having a transverse aperture for passage of the elongated plate, the connection between the elongated plate and the stabilizer is realized by non-mechanical means, as for instance by two pairs of magnets respectively fixed to the plate and to the stabilizer, the facing poles of the magnets of each pair being of selected polarity capable of generating forces which tend to maintain an equal air gap in both pairs during normal operation. Resilient limiting abutments prevent impacts of the magnets against each other when the spindle is started or braked.

7 Claims, 3 Drawing Figures

Fig. 1
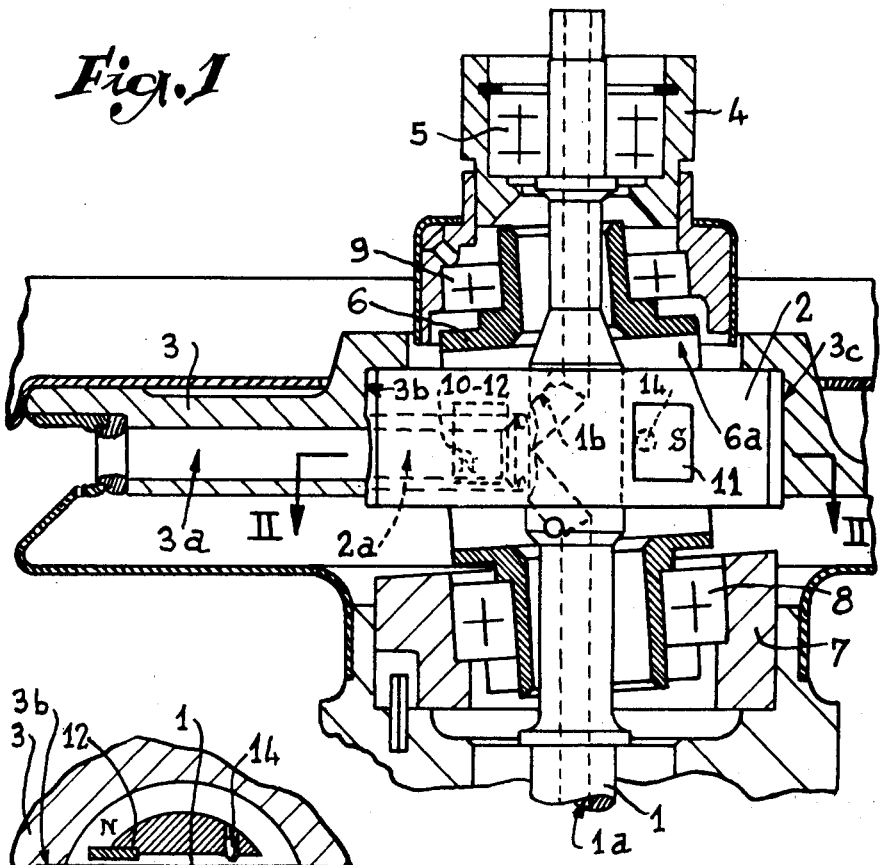
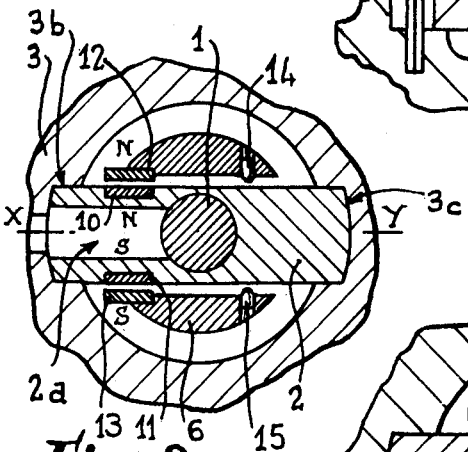
Fig. 3
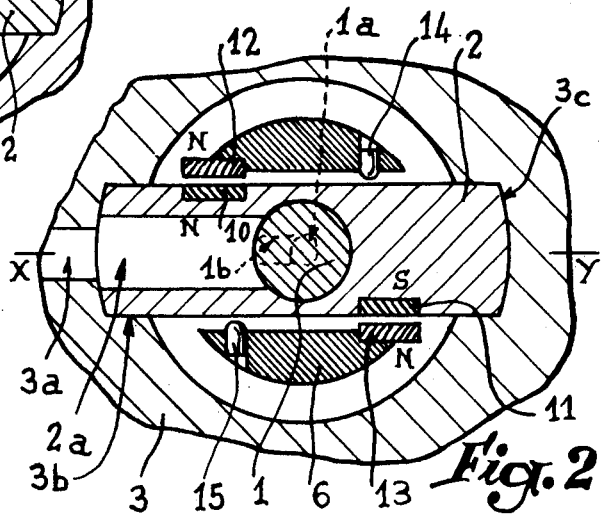
Fig. 2

DOUBLE TWIST SPINDLE INCLUDING A DRIVE WITHOUT CONTACT BETWEEN ITS PLATE AND ITS STABILIZER

The present invention relates to double-twist spindles for textile machines of the kind including an elongated plate which passes through an inclined rotating stabilizer.

In order to obtain a regular rotation of the stabilizer during normal operation, these spindles generally comprise a mechanical connection between the stabilizer and the plate. The connecting member wears out rapidly and it is then necessary to stop the machine in order to proceed to the replacement of this member. Moreover the frictional effects which appear between the said member and the elements with which it is associated generate vibrations and noise.

It is the object of the present invention to avoid these inconveniences by eliminating the conventional mechanical connecting member. The noise generated by the machine concerned is thus considerably reduced and the operative conditions of the spindle are improved due to the increased flexibility of a non-mechanical connection.

In accordance with the present invention, in a double-twist spindle of the kind above referred to, the connection between the plate and the stabilizer comprises means avoiding any mechanical contact. In a preferred embodiment the said connection is effected magnetically through the medium of magnets disposed on one and the other of the respective elements and which generate between these magnets forces which maintain a free space or air gap between them.

In the accompanying drawings

FIG. 1 is a fragmental longitudinal section showing the lower portion of a double-twist spindle according to the invention.

FIG. 2 is a fragmental transverse section taken along line II–II of FIG. 1.

FIG. 3 is a cross-section similar to FIG. 2, but to a reduced scale and corresponding to a modified embodiment.

Referring to FIG. 1 reference numeral 1 designates a central shaft which is rotatably supported in the conventional manner by means not illustrated. The elongated plate 2, here in the form of a transverse bar, is keyed on this shaft 1 and it forms a diametral support for the usual annular disk 3. The bobbin-carrier 4 is mounted on shaft 1 by means of roller bearings 5 above plate 2. The thread unwound from the bobbin, not illustrated, passes downwardly through the bore 1*a* of shaft 1 and it issues therefrom through an obliquely directed passage 1*b* which opens in a radial channel 2*a* pierced in plate 2, this bore communicating with a radial hole 3*a* of disk 3.

Rotation of the bobbin-carrier 4 is prevented in the conventional manner by a hollow stabilizer 6 which is rotatably mounted along an inclined axis in a lower ring 7, fixed to the machine frame, by means of a first roller bearing 8, and in the bobbin-carrier 4 by means of a second roller bearing 9.

As above indicated, and as more particularly illustrated in FIG. 2, the elongated plate 2 is in the form of a rectangular diametral bar having its ends engaged in depressions 3*b*, 3*c* of the disk 3. This bar passes with a considerable clearance through a transverse aperture 6*a* provided in the stabilizer 6.

As hitherto described the arrangement is quite conventional. When the main shaft 1 is rotated, it drives the diametral bar or plate 2 which in turn drives the disk 3 which it supports. The bobbin-carrier 4 is retained against rotation by the inclined stabilizer (bobbin-carrier 4 may be considered as rotatably mounted about two different axes, namely the vertical axis of shaft 1 and the inclined axis of stabilizer, both being stationary in the space). But the problem is that the stabilizer 6 must rotate about its own inclined axis in order to permit rotation of the diametral bar or plate 2. In the known double-twist spindles of the kind in question this is achieved by providing a mechanical connection between these elements. As above explained this solution affords the inconvenience that the connecting member has to be frequently replaced and also that it generates noise in operation.

In accordance with the embodiment of the present invention illustrated in FIGS. 1 and 2, this problem is solved by inserting in the lateral sides of plate 2 and symmetrically with respect to the axis of shaft 1 two flat permanent magnets 10, and 11 of opposed polarities (or more exactly speaking, the exposed faces of which are of opposed polarities), namely South and North in the case illustrated, while two other permanent magnets 12, 13, having the same polarity (North in FIG. 2) are mounted in the aperture 6*a* of stabilizer 6 respectively opposite to magnet 10 and to magnet 11, thus forming two pairs of facing magnets. A repulsive force thus appears between the magnets 10 and 12 of the first pair, while an attractive force is generated between magnets 11 and 13 of the second pair. These forces act on stabilizer 6 in opposition to each other and experience shows that in normal operation an equilibrium is reached at which the air gap between the facing magnets is substantially the same in both pairs. When shaft 1 rotates together with plate 2, stabilizer 6 is therefore entrained without any mechanical contact with any other part. Of course in operation the frictional or other forces which tend to retard stabilizer 6 may cause minor variations of the respective air gaps, but this has no inconvenience whatever. It may however occur, more particularly when the spindle is started and when it is braked, that one of these air gaps tends to disappear, or in other words that the magnets of one of the pairs come into contact with each other. Since this could involve impacts liable to deteriorate the magnets, in order to limit the relative motion between the plate and the stabilizer abutments 14 and 15 are arranged in this latter. These abutments 14 and 15 are conveniently made of an elastomeric material in order to act as damping members.

In the modified embodiment of FIG. 3 the pairs of permanent magnets are disposed symmetrically with respect to the common axis XY of channel 2*a* and of hole 3*a*. In other words they are aligned transversely. The magnets are of same polarity in both pairs and they thus generate repulsive forces which here again tend to cause relative rotation of stabilizer 6 in one and the other directions, the forces which appear in one pair decreasing when the air gap increases, while the force increases in the other pair when the air gap decreases. As in the case of FIG. 2 in normal operation air gaps of substantially equal thickness are thus obtained between the magnets of each pair, while the resilient limiting abutments 14 and 15 prevent any impact of these magnets against each other when the spindle is started or stopped.

It is to be noted that a repulsive action each side of plate 2, as in the embodiment of FIG. 3, could also be obtained by means of air jets instead of magnets, this type of action being referred to in the claims as being a remote action since no mechanical contact is required between the stabilizer and the plate carried by the shaft.

What I claim is:

1. In a double-twist spindle of the kind including:

a central rotating shaft, said shaft having a first axis;

a bobbin-carrier rotatably supported by said shaft;

an elongated plate carried by said shaft to rotate therewith, said plate extending transversely of said shaft;

an annular disk fixed to the ends of said elongated plate, said disk having a central aperture;

a fixed ring surrounding said shaft on the other side of said elongated plate with respect to said bobbin-carrier;

a hollow stabilizer surrounding said shaft, said stabilizer having a second axis at an angle to said first axis, said stabilizer also having a first and a second end, and said stabilizer extending through the central aperture of said annular disk and being formed with a transverse aperture to accomodate said elongated plate;

means to mount the first end of said stabilizer in said bobbin-carrier to permit said stabilizer to rotate about said second axis;

means to mount the second end of said stabilizer in said ring to permit said stabilizer to rotate about its axis;

and means to angularly connect said elongated plate with said stabilizer to cause positive rotation of said stabilizer about said second axis when said shaft rotates about said first axis;

said bobbin-carrier being thus retained against rotation by said stabilizer during rotation of said shaft;

the improvement in said last-named means which consists of means developing a remote action between said elongated plate and said stabilizer without any mechanical connection between them during normal operation of said spindle.

2. In a double-twist spindle as claimed in claim 1, said means to connect said elongated plate with said stabilizer comprising first means tending to rotate said stabilizer in one direction with respect to said elongated plate and second means tending to rotate said stabilizer in the other direction with respect to said elongated plate.

3. In a double-twist spindle as claimed in claim 1, abutment means to limit the angle of rotation of said stabilizer with respect to said elongated plate.

4. In a double-twist spindle as claimed in claim 3, said abutment means being resilient.

5. In a double-twist spindle as claimed in claim 1, said remote action being magnetic.

6. In a double-twist spindle as claimed in claim 1, said means to angularly connect said elongated plate with said stabilizer comprising a first and a second pair of permanent magnets, the first and second magnets of each pair facing each other, with the first one being fixed to said elongated plate and the second one being fixed to said stabilizer, and with said first and second pairs of magnets being so arranged that the magnetic force developed by said first pair tends to rotate said stabilizer in one direction with respect to said elongated plate, while the magnetic force developed by said second pair tends to rotate said stabilizer in the other direction.

7. In a double-twist spindle as claimed in claim 6:

said first and second magnets of each of said first and second pairs each having a pole which faces a pole of the other magnet of the same pair;

said facing poles of each of said first and second pairs being separated by an air gap;

said facing poles of the first and second magnets of each of said pairs being of same polarity to develop repulsive forces through said air gap between said paired magnets;

and said first and second pairs of magnets being so disposed on said elongated plate and on said stabilizer that when said stabilizer is angularly displaced with respect to said elongated plate, the air gap which separates the facing poles of the magnets of one of said pairs increases while the air gap which separates the facing poles of the magnets of the other one of said pairs decreases.

* * * * *